United States Patent [19]

Parrier et al.

[11] 4,094,565

[45] June 13, 1978

[54] SAFETY ELECTRIC CONNECTOR

[76] Inventors: André Parrier; Jean Perrier, Henri Parrier, all of rue de la Sabliere, St. Genis les Ollieres (Rhone), France

[21] Appl. No.: 749,791

[22] Filed: Dec. 13, 1976

[30] Foreign Application Priority Data

Dec. 12, 1975 France ..... 75 39398

[51] Int. Cl.[2] ..... H01R 3/06

[52] U.S. Cl. ..... 339/14 P; 339/113 R; 339/191 S; 339/195 R; 339/203

[58] Field of Search ..... 339/14 P, 14 R, 63 M, 339/113 R, 176 R, 191 R, 191 S, 195 R, 203

[56] References Cited

U.S. PATENT DOCUMENTS 1,753,317 4/1930 Rothen ..... 339/191 S

FOREIGN PATENT DOCUMENTS 35,220 4/1935 Netherlands ..... 339/191 S

*Primary Examiner*—Roy Lake
*Assistant Examiner*—DeWalden W. Jones
*Attorney, Agent, or Firm*—Remy J. VanOphem

[57] ABSTRACT

The invention relates to a safety electric connector. A conductive pin is slidably mounted within a socket. A sheath and a washer isolate the pin. Two further pins and the earth terminal are electrically connected to a plate which is connected to earth through a detection arrangement. Safety is assured even when the earth is not connected to the ground.

The invention can be applied to the detection of an insulation fault and cutting off of power supply to a machine not connected to earth.

10 Claims, 8 Drawing Figures

SAFETY ELECTRIC CONNECTOR

BACKGROUND OF THE INVENTION

The present invention is concerned with an electric connector whose construction obviates electrocution accidents.

Safety arrangements suitable for connectors of known type are known. A well-known safety arrangement is constituted by a disc carrying two pins of insulating plastics material and formed when a socket is not in use, the insulating pins of the disc are engaged in the holes of the socket. This system permits isolation of a socket and protection against the risks of electrocution, especially for children.

This safety arrangement (which can equally be used with three phase, the disc having three pins) has inconveniences. The main one is that it can only be put in place when the socket is not in use. Moreover, the plastic pins frequently break inside the socket and thus it is necessary to replace same.

It is known that practically all industrial machines and, increasingly, a number of important domestic appliances must be earthed. In an installation, domestic or industrial, all the earths of machines are connected together and to a wire which is theoretically put into the ground. In practice, there is frequently a fault in the power supply system. For example, the earth of a machine is not connected to the earth pin of the connector. It may happen also that all the earths of the electric machines of an installation may be correctly connected together and branched to the earth wire of the power supply network; but said wire is not connected to earth.

In these conditions, it is evident that the electric installation is no longer safe in the case of a short circuit. Indeed, when a machine is badly insulated, the earth wire whose electric resistance is lower than that of the user shunts the short-circuit current. If the connection between the ground and the earth of the machine is not assured, the current passes to the user with risk of electrocution.

SUMMARY OF THE INVENTION

The present invention has for its object the obviating of these inconveniences by providing an electric connector with which is integral a permanently functioning safety arrangement, that is to say, whether the connector is in use or not.

A safety electric connector according to the invention is characterized in that it is constituted by a socket wherein each terminal pin comprises a conductive tubular part connectable to an electric supply, and a conductive pin, slidably mounted inside each tubular part, and connected to an earth terminal, each slidable pin being disposed inside an insulating sheath while the wires of the socket are connected to a fault detecting apparatus.

Preferably, the socket is complemented by a male plug for connection to a machine to be operated, the tip of each pin of this plug being covered by an insulating film so that upon inserting the plug in the socket electrical contact is established between the lateral walls of the pins and the tubular parts.

Preferably also, the inner end of a slidable pin comprises an insulating washer integral with the insulating sheath of the pin and preventing any contact between the metallic elements of the pin and the conductive tubular part connected to a supply phase.

Preferably also, the pin is extended towards the interior of the socket by a finger of lesser cross section serving to guide a metallic helical spring whereof the ends rest, one on a conductive plate constituting the earth of the installation and connected to the detection apparatus, the other on a shoulder formed by the interior end of the pin and the guide finger.

Preferably also, the safety socket can be used in monophase or three phase systems. The earth terminal is constituted by a metallic tube connected by the conductive or earth plate to the slidable pins. This terminal receives a conductive pin connected to the earth of the machine in use, while the safety system functions even if the earths of the machine and the socket are not connected to the ground.

Preferably also, the pins of the socket slide independently of one another so that in the case of an insulation fault, the socket indicates which pin is defective.

Preferably also, the distance between the external surface of the socket and the end of a conductive tubular part varies from one terminal to another so that when one pushes in the plug, electrical contact is established on one line before the other.

Preferably also, each slidable pin of an inoperative socket is flush with the exit of the insulating moulding, the metallic core extending very slightly from its insulating sheath. Preferably also, the safety socket permits the detection of an insulation fault of the apparatus in use through the intermediary of the plug comprising a pin connected to the earth of the socket. The detection apparatus causes immediate cut off of the supply.

BRIEF DESCRIPTION OF THE DRAWING

The present invention will now be described by way of example with reference to the accompanying drawings in which.

DETAILED DESCRIPTION OF THE PREFERRED EMBODIMENT

Figure 1:
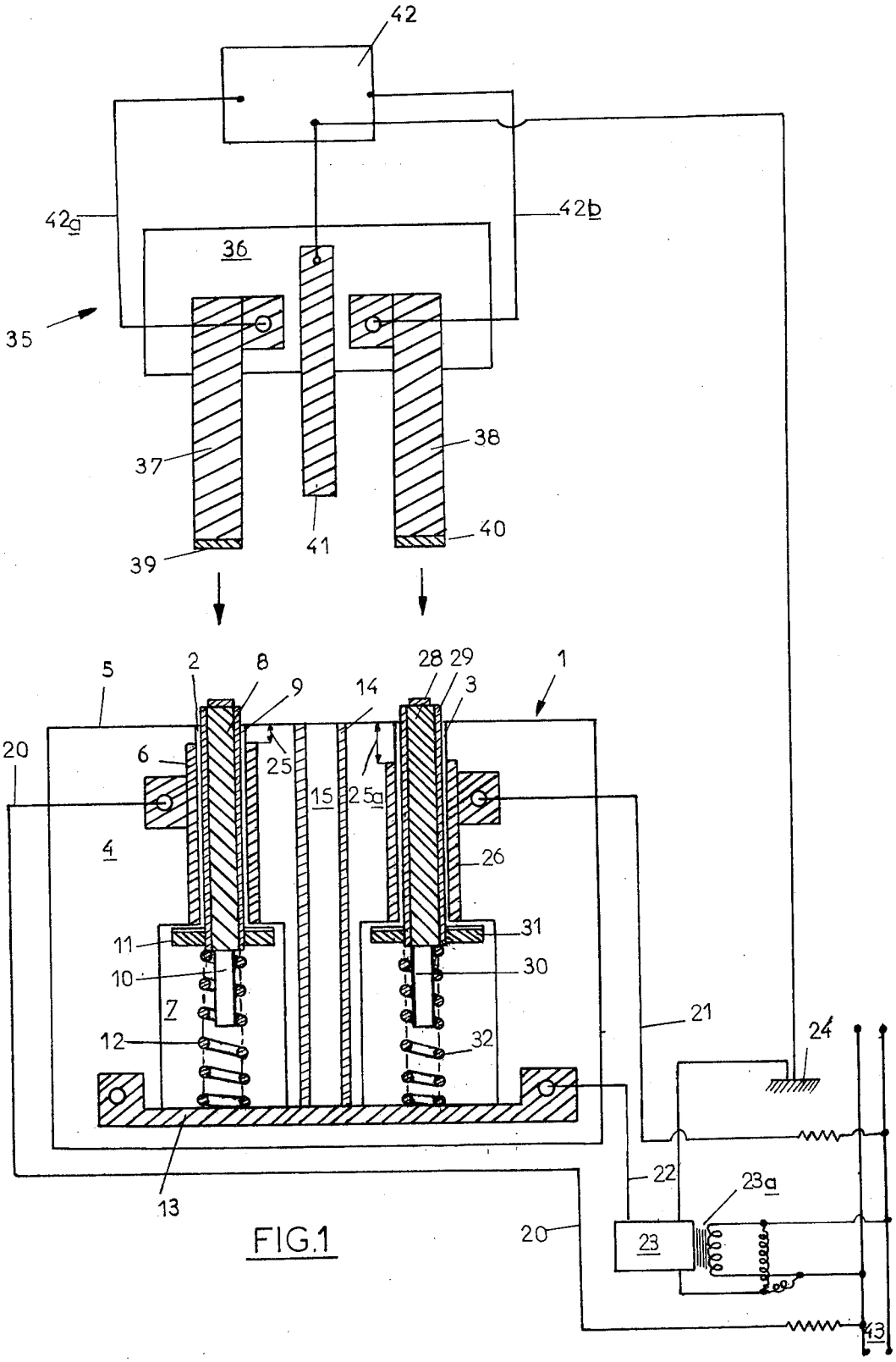
FIG. 1 is a view showing the structure of a safety socket, according to the invention, and of a complementary plug.

Referring to FIG. 1, there is shown a detailed structure and the electrical circuitry of a safety socket 1 according to the invention. This socket 1 comprises two tubular bores 2 and 3. The structure of these bores are identical and only one will be described. The bore 2 is covered with insulating material 4 which covers the conductive portions of the socket. The bore 2 is open at one end on the front 5 of the socket and at the other end in cavity 7. A tubular metallic cylinder 6 comprises the wall of the bore 2 except for a small distance before the front 5. The metallic cylinder 6 is connected to a lead 20.

A pin 8, for example of brass, is slidingly mounted in the interior of the bore 2. This pin 8 is covered by an insulating sheath 9 intended to isolate the metallic parts 6 and 8. A metallic finger 10 is carried axially on the interior tip of the pin 8, which finger 10 has a cross section less than the cross section of the sliding pin 8. Close to this interior tip, a washer 11 of an insulating material is integral with the sheath 9 of the pin. At the outward tip of the pin 8, the metallic core of the pin projects slightly from the insulating sheath 9. In an out-of-use position, the pin is substantially flush with the front face of the socket owing to the effect of a helical metallic spring 12 guided by the finger 10. One end of the spring 12 bears against the shoulder between the pin 8 and the finger 10 and the other end of the spring 12 bears against a metallic plate 13 inside the socket. The plate 13 is connected, by means of a lead 22 and across a device 23 for detecting insulation faults, to earth 24.

The structure of the tubular bore 3 is similar to that described above. It comprises:

a tubular metallic cylinder 26 connected to the second lead 21;

a sliding pin 28 surrounded by a sheath 29 and an insulating washer 31;

a helical spring 32 guided by a metallic finger 30 and which ensures an electrical contact between the pin 28 and the plate 13 connected to earth.

The front tip of the tubular cylinder 6 is situated a distance 25 from the front face of the socket. This distance 25 is different (for example less than) from the distance 25*a* between the front tip of the tubular cylinder 26 and the front face 5 of the socket. The purpose of this construction will be described later.

The socket 1 comprises moreover a bore 15 in which is fixed a conducting tube 14 in contact with the plate 13. This bore is intended to receive the earth pin of a plug for supplying power to a machine from the socket 1.

The plug 35 comprises, embedded in an insulating material 36, two brass pins 37 and 38 whose tips are covered by insulating films 39 and 40 respectively. The pins 37 and 38, as well as the earth pin 41 (which is shorter), are positioned in order to engage respectively in the bores 2, 3 and 15, when the plug is pushed into the socket to supply power to apparatus 42.

The safety device of the socket 1 is constituted by a detection and trip mechanism 23 permanently supplied with a continuous voltage from the secondary windings of a transformer 23*a*, the primary windings of which are shunted into the electrical network 43. The mechanism 23 is of a type described in French Patent No. 7503 653 filed Jan. 31, 1975, in the same name of the present applicants and Jacky Vitte under the title "Security apparatus for the detection of faults in the electrical insulation between two leads of a power supply circuit for a machine." The details of this apparatus will not, therefore, be described herein. It is sufficient to know that the apparatus comprises a surveillance circuit maintained under a permanent voltage, a transistorised trip circuit mounted between a terminal of a cut-off relay and an earth wire. A short circuit must occur when an insulation fault occurs between two leads, or between a lead and the induced earth. As soon as its intensity attains a value of the order of a milliamp, the polarity of the transistor changes and the relay cuts off the power. It is known, in particular, that this apparatus functions whether the earth lead is connected to the ground or not.

Figure 3:
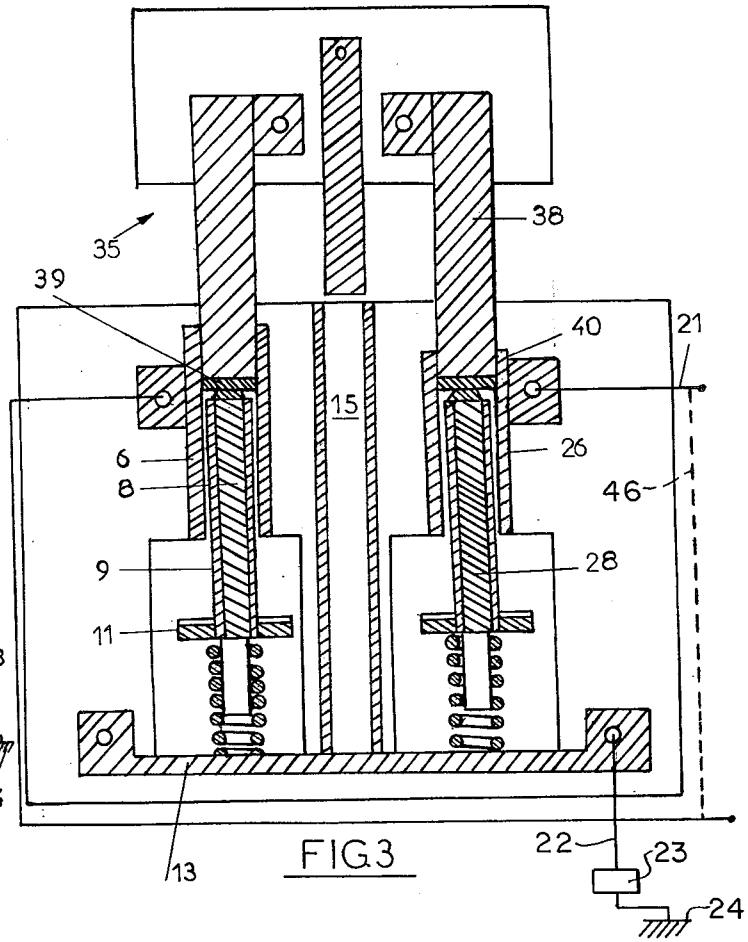
FIG. 3 shows the safety arrangement in a second phase.
Figure 2:
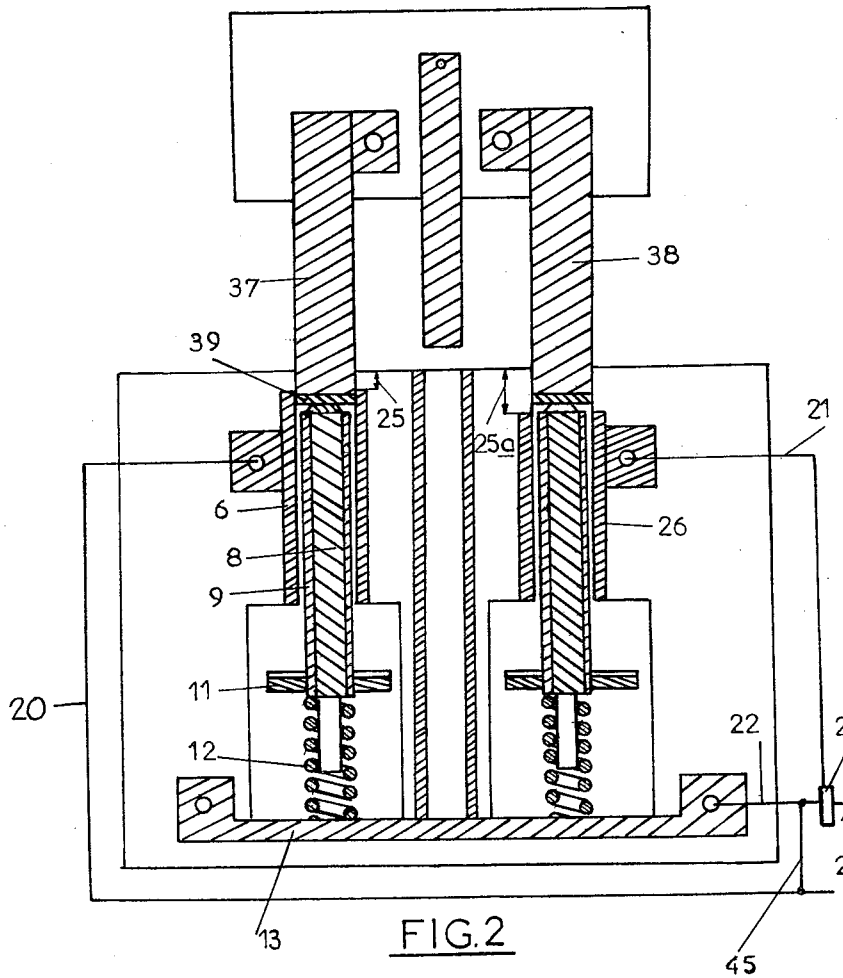
FIG. 2 shows the detection of a possible fault in the first phase of contact when one inserts the plug for the supply of power to a machine.
Figure 4:
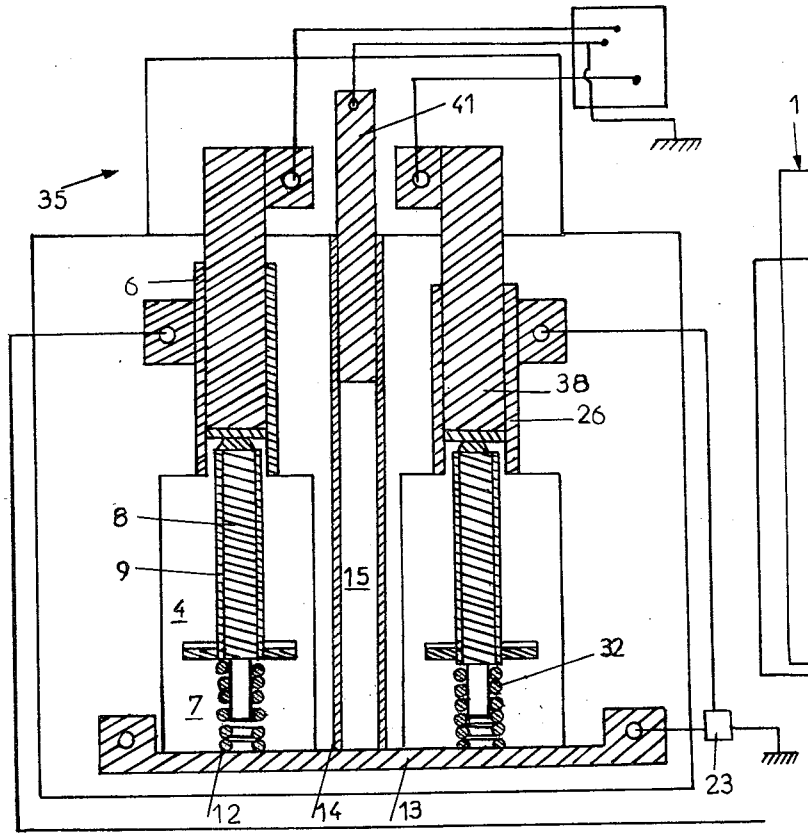
FIG. 4 shows the safety arrangement assured by means of the socket when the body of the machine is not correctly insulated.

When the power supply of the machine or the apparatus 42 is plugged in, the safety socket with sliding pins connected to earth, detects all the anomalies or faults of the insulation. Its construction equally allows the identification of the defective parts. This function is shown in FIGS. 2 to 4.

(a) when the pins 37 and 38 come in contact with the tip of the sliding pins 8 and 28, the insulation between the leads of the machine 42 and earth is ensured by means of the insulating films 39 and 40.

(b) the pins 37 and 38 push the sliding pins 8 and 28 to compress the springs 12 and 32. When plug 35 is pushed into a greater depth than the distance 25, the lateral metallic wall of the brass terminal 37 come into contact with the tubular cylinder 6 connected to lead 20. If an insulation fault exists between the earth wire 22 and the lead 20, a short circuit 45 occurs which is injected into the tripping circuit of the apparatus 23 and cuts off the power supply to the plug (FIG. 2). One knows then that the fault is localised in the lead 20. In effect, the lead 21 is not yet shunted because of the displacement of the metallic tubular cylinders 6 and 26.

(c) generally, no insulation fault occurs between the earth 22 (not connected to the ground) and the lead 20. One continues then to push the plug in the socket 1. The lateral walls of the pin 38 are brought into contact with the tubular cylinder 26 if the current in the lead 21 also flows into the power supply lead of the machine. The detection device cuts off the power supply if an insulation fault appears either between the lead wire 21 and the earth wire 22, or between the lead wire 21 and the lead wire 20. The short circuit 46 polarises the transistor of the tripping circuit (FIG. 3).

(d) the condition of the socket being correct, (no short circuit 45 or 46) one continues to push in the plug 35 of the machine. The pin 41 connected to the earth of the machine 42 engages in the bore 15. If an insulation fault appears in the machine in use between earth and a phase of the machine the detection apparatus and the safety socket cause a cut-off of the power source (FIG. 4).

Safety is assured by the socket and the detection apparatus 23 in the case where a person, notably a child, accidently pushes a conductive element in one of the holes.

Figure 5:
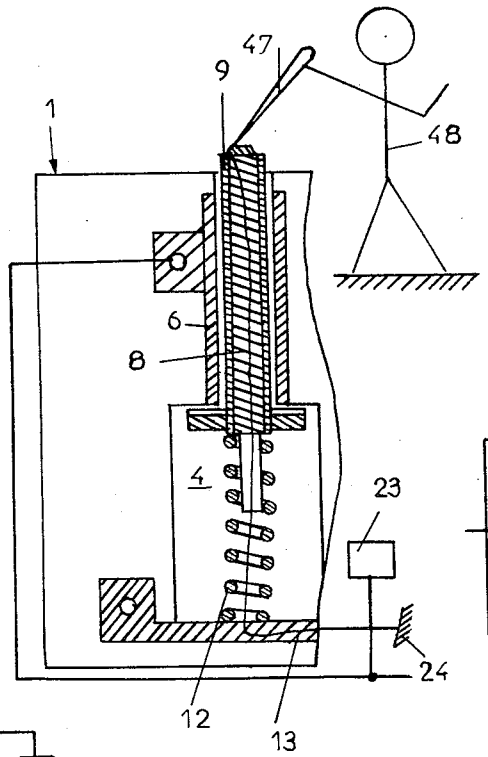

In a first case, the conductive element 47 is only in contact with the end of a slidable pin 8. One has seen that this pin is connected to earth by the conductive plate 13. One also knows that this earth cannot be connected to the ground. If the earth potential is different from the ground potential, a short circuit occurs between the plate 13 of the socket and the metallic element 47 held by the child 48 standing to the ground. This short circuit is detected by the apparatus 23 which instantly cuts off supply to the socket (FIG. 5).

Figure 6:
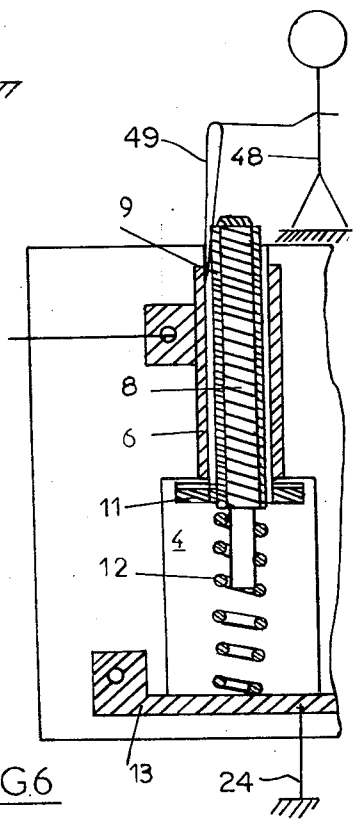
FIGS. 5 and 6 show the safety arrangement assured by means of the sliding pin of a socket, but not in use.

In a second case, the slidable pin 8 can be pushed in sufficiently for example with the help of a metallic needle 49. This conductive element 49 establishes a short-circuit between phase 20 connected to the tubular cylinder 6 and the end of the pin 8 connected to earth. This short circuit instantly trips the detection apparatus and cuts off supply to the socket (FIG. 6). It would be the same if one would succeed in introducing a metallic wire between the insulating sheath 9 and the tubular cylinder 6. The short circuit established between phase 20 and the user 48 would cut off the supply.

Figure 7:
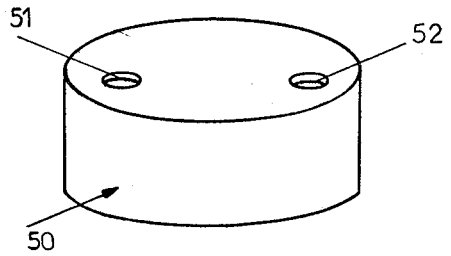
FIG. 7 shows a safety socket, according to the invention, two terminals of this socket being equipped with sliding pins.
Figure 8:
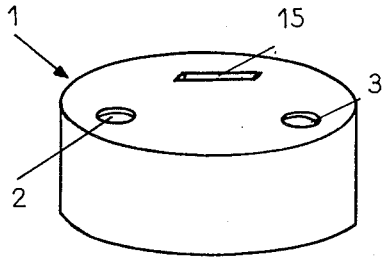
FIG. 8 shows a socket with two live terminals and an earth terminal.

FIGS. 7 and 8 show respectively safety sockets with two and three terminals. The two terminal socket shown in FIG. 7 is particularly adapted to domestic usages for apparatus, whereof an earth provision is not necessary. Each of the two bores 51 and 52 of this socket 50 includes a slidable pin conforming to the previous description.

The socket of FIG. 8 corresponds to socket 1. It comprises two terminals (live and neutral) 2 and 3 provided with slidable pins and an earth terminal 15.

Among the principal advantages of the safety socket according to the present invention are:

the safety arrangement is integral with the socket, it does not require removal of a separate element when it is desired to use the socket;

the safety arrangement functions whether the socket is in service or not; and the safety arrangement extends to the detection of a fault in the apparatus in use.

What is claimed is:

1. A safety electric connector comprising a socket wherein each terminal comprises at least one conductive tubular part connectable to an electric supply; a conductive pin slidably mounted inside each tubular part, said conductive pin being connected to an earth terminal, each conductive pin further being disposed inside an insulating sheath while the wires of the socket are connected to a fault detecting apparatus; and an insulating moulding encapsulating said at least one tubular part.

2. A connector as claimed in claim 1, wherein the connector further includes a plug for connection to a machine to be operated, wherein said plug has at least one pin and the tip of each pin of said plug being covered by an insulating film, so that, upon inserting said plug into said socket, an electrical contact is established between the lateral walls of the pins and the tubular parts.

3. A connector as claimed in claim 1, wherein the inner end of each slidable pin includes an insulating washer integral with the insulating sheath of the pin and preventing any contact between the metallic elements of the pin and the conductive tubular part connected to said electrical supply.

4. A connector as claimed in claim 1, wherein each pin is extended towards the interior of the socket by a guide finger of lesser cross section serving to guide a metallic helical spring, whereof one end of said spring rests on a conductive plate constituting the earth of the installation, said conductive plate being connected to the detection apparatus and the other end of said spring rest on a shoulder formed by the interior end of the pin and the guide finger.

5. A connector as claimed in claim 1 wherein said connector further includes an earth terminal, said earth terminal is a metallic tube connected to the conductive or earth plate and to the slidable pins, said terminal receiving a conductive pin connected to the earth of the machine in use, while the safety system functions even if the earths of the machine and the socket are not connected to the ground.

6. A connector as claimed in claim 1 wherein said conductive pins of the socket slide independently one of another so that, in the case of an insulation fault, the socket indicated which is the defective conductive pin.

7. A connector as claimed in claim 1 wherein the distance between the external surface of the socket and the end of each conductive tubular part varies from one terminal to another, so that, when the plug is pushed in electrical contact is established on one line before the other.

8. A connector as claimed in claim 1, wherein each slidable conductive pin of an unoperative socket is flush with the exit of the insulating moulding defining the socket, the metallic core of the pin extending very slightly from its insulating sheath.

9. A connector as claimed in claim 1 wherein said fault detecting apparatus permits the detection of an insulation fault of the apparatus in use through the intermediary of the plug comprising a pin connected to the earth of the socket, said detection apparatus causing immediate cut off of the eletrical supply.

10. A connector as claimed in claim 1 further adapted to be used with mono phase or three phase currents, irrespective of whether the earth is connected to ground.

* * * * *